United States Patent [19]

Wolter

[11] Patent Number: 4,705,031

[45] Date of Patent: Nov. 10, 1987

[54] OSTEOSYNTHESIS PLATE FOR PRESSURE STABILIZATION

[76] Inventor: Dietmar Wolter, Lohmühlenstrasse 5, 2000 Hamburg 1, Fed. Rep. of Germany

[21] Appl. No.: 859,650

[22] Filed: May 5, 1986

[30] Foreign Application Priority Data

May 6, 1985 [DE] Fed. Rep. of Germany ... 8513286[U]

[51] Int. Cl.[4] ..... A61M 37/00

[52] U.S. Cl. ..... 128/92 YP; 128/92 YM; 128/92 ZZ

[58] Field of Search ..... 128/92 YP, 92 YM, 92 ZZ, 128/92 YN, 92 YO

[56] References Cited

U.S. PATENT DOCUMENTS 4,119,092 10/1978 Gil ..... 128/92 YP
4,364,382 12/1982 Mennen ..... 128/92 YP
4,429,690 2/1984 Angelino-Pievani ..... 128/92 YP

FOREIGN PATENT DOCUMENTS 1505513 11/1967 France ..... 128/92 YP

*Primary Examiner*—Stephen C. Pellegrino
*Assistant Examiner*—John D. Ferros
*Attorney, Agent, or Firm*—Chilton, Alix & Van Kirk

[57] ABSTRACT

An osteosynthesis plate for the pressure stabilization of bone fragments. To obtain great compression lengths without the need for a separate compression device. The plate is provided in each of its sections allocated to a bone fragment with two elongate slots which each contain several ramp hole sections, the pitch spacings of the ramp hole sections belonging to the same elongate slot being not greater than the number of the elongate slots allocated to the same bone fragment, multiplied by the useful ramp lengths. In general, two elongate slots suffice, in which the useful ramp length corresponds in each case to half a pitch spacing.

4 Claims, 2 Drawing Figures

OSTEOSYNTHESIS PLATE FOR PRESSURE STABILIZATION

Figure 1:
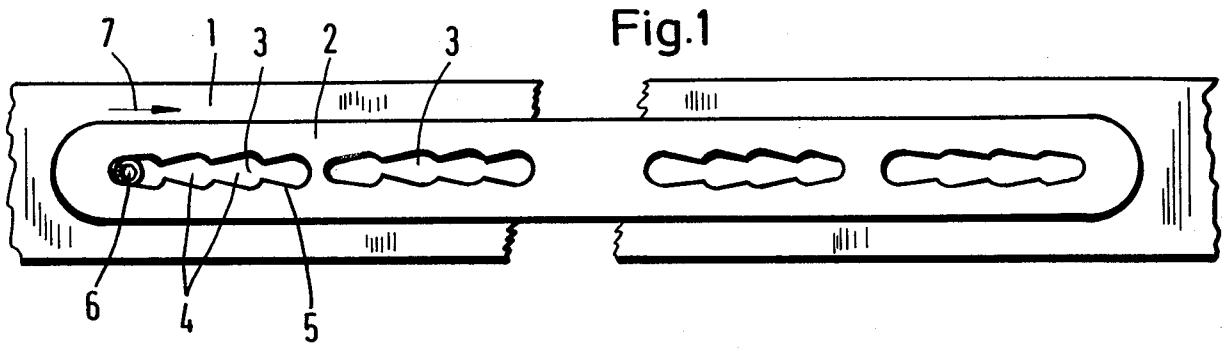

The present invention relates to an osteosynthesis plate for the pressure stabilization of bone fragments.

In osteosynthesis, it is known that bone healing is promoted by stability and pressure in the bone fissure. Tensioning devices have therefore been developed which, in conjunction with osteosynthesis plates, allow pressure stabilization of the bone fragments. These include osteosynthesis plates, the screw holes of which have hole walls angled in the manner of an inclined plane, termed ramps below, so that, when a bone screw is screwed in, the screw head slides on the ramp and thus effects a displacement of the plate in relation to the bone fragment which receives the bone screw. The greatest possible compression length, which is determined by the hole geometry and the thickness of the plate, is here very short. Greater compression lengths can be obtained by means of a special tensioning device which is applied in addition to the osteosynthesis plate. If this device is firmly screwed to a bone fragment outside the bone plate, it has the disadvantage of a larger wound, greater surgical effort and a longer operating time. If it is fitted in the region of the osteosynthesis plate in conjunction with an elongate slot provided in the latter (German Offenlegungsschrift No. 3,134,120), the scope of supply may be restricted, depending on the nature of the form of the fracture and on the position of the elongate slot.

It is the present object of the invention to provide an osteosynthesis plate which, for pressure stabilization, utilizes the simplicity and proven effectiveness of the ramp holes and nevertheless allows a greater compression length.

According to the invention, this object is achieved when several elongate slots allocated to the same bone fragment and each having several ramp hole sections are provided, the pitch spacings of the ramp hole sections belonging to the same elongate slot being not greater than the number of the elongate slots allocated to the same bone fragment, multiplied by the useful ramp length. In order to be able to manage with only two elongate slots, the pitch spacings of the ramp hole sections are advantageously smaller than twice the useful ramp length.

The osteosynthesis plate according to the invention is used in such a way that bone screws are alternately screwed into the various elongate slots and slackened again. After a first bone screw has been screwed in within a first elongate slot in a ramp hole section therein located close to the fracture, whereby a first compression step would be carried out, a second bone screw is applied in another elongate slot in such a way that it engages in the start of a ramp. The first screw is then slackened and a second compression step is carried out by screwing in the second screw. When the pitch spacings of the ramp hole sections are smaller than twice the useful ramp length, the first screw has reached, during the second compression step, the start of a further ramp hole section and is brought into engagement with the latter, whereupon the second screw can be slackened and the first screw is screwed in again, which results in a third compression step, and so on. If three elongate slots are provided and the useful ramp length corresponds to one third of the pitch spacings, three screws are alternately screwed in and slackened in a corresponding manner.

In this way, compression lengths of any desired magnitude can be overcome. This is important particularly in the case of osteotomies, for example in the region of the hip joint, because it may become necessary in that case for compression of the cutting surfaces to overcome lengths from several millimetres up to the order of magnitude of 1 cm.

Of course, this principle is also applicable to the direction of motion converse to compression, for the purpose of decompression. This possibility, in which the ramp arrangement in the plate sections allocated to the two bone fragments is inverted, is therefore intended also to be covered by the appended claims.

Figure 2:
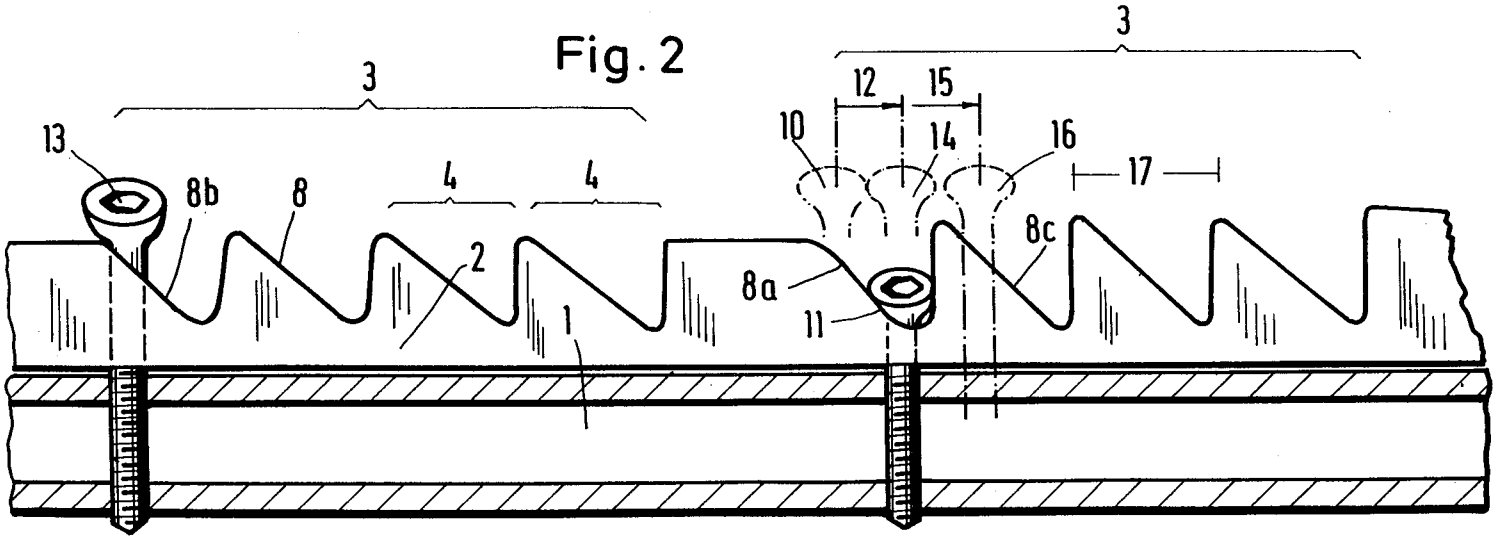

The invention is explained in more detail below by reference to the drawing in which:

FIG. 1 shows a diagrammatic plan view of the plate according to the invention and FIG. 2 shows the functional principle in an enlarged, diagrammatic representation.

The osteosynthesis plate 2, located in FIG. 1 on a bone 1 with a transverse fracture, contains, in its sections allocated to each of the two bone fragments, two elongate slots 3 which each have four hole sections 4 which can each be seen as a pair of mutually opposite boundary arcs 5 and are each provided with a ramp and are therefore designated here as ramp hole sections. The ramps on the left-hand side in FIG. 1 are arranged with a drop towards the right, whereas the ramps on the right-hand side are arranged with a drop towards the left, so that, when the bone screw located at 6 in FIG. 1 is screwed in, a movement of the allocated bone fragments in the direction of the arrow 7, that is to say in the direction of compression, results. Details of this function are then shown by reference to FIG. 2 which represents that section of the osteosynthesis plate—greatly enlarged relative to the bone 1—which is on the left in FIG. 1. The regions in which the elongate slots 3 are located are indicated in FIG. 2 by corresponding brackets. The ramps 8 allocated to the particular ramp hole sections 4 can herein be seen as inclined planes.

Initially, a first bone screw is inserted in position 10 into the elongate slot which is on the right in FIG. 2, in its end remote from the fracture. When screwed in, its screw head slides down the inclined plane **8*a* and, in doing so, takes the bone 1 along, which is located below and is thus displaced in the direction of the arrow by the length 12. The second bone screw is then inserted in position 13 above the elongate slot which is on the left in the drawing, at its end remote from the fracture, and screwed in until it strikes the allocated inclined plane 8*b* and thus secures the bone 1 relative to the osteosynthesis plate in the position reached. The first screw is then slackened up to the position 14 in which it is located freely above the plate. As a result of screwing in the second screw, the bone is displaced in the direction of the arrow by the section 15, the first screw migrating from position 14 into position 16 in which it is located above the ramp 8*c*** of the next ramp hole section. It can then be brought into engagement with this ramp, whereupon the second screw is slackened, and so on. As a result of the alternating screwing-in and slackening of the screw, a compression length of any desired magnitude is obtained in this way.

In the example shown, the useful ramp length is in each case approximately equal to the sections 12 or 15 or a little greater. This is that length by which the bone is displaced relative to the osteosynthesis plate when one screw moves from one extreme end of a ramp to the other extreme end of the same ramp. The pitch spacing between two ramp hole sections is marked 17 in FIG. 2.

I claim:

1. An osteosynthesis plate for the pressure stabilization of bone fragments, comprising;

a base plate for spanning the bone fragments, the base plate having a first end adapted to lie on a first bone fragment and an opposed second end adapted to be secured on a second bone fragment;

at least one slot in the first end of the base plate, each slot being elongated in the direction between said plate ends, each slot having a plurality of screw hole sections adapted to receive a bone screw, the sections lying end-to-end on a uniform pitching spacing;

each of said screw hole sections including a ramp sloped downwardly in the direction toward the second end of the base plate, the ramp having a useful ramp length defined by the distance the base plate would move relative to the first bone fragment as a bone screw is advanced into the bone fragment from an initial position at the top of the ramp to a final position at the bottom of the ramp;

wherein the pitch for the screw hole sections in a given slot is no greater than the number of slots in said first end of the plate, multiplied by the useful ramp length.

2. The osteosynthesis plate according to claim 1, wherein the pitch spacing is smaller than twice the useful ramp length.

3. The osteosynthesis plate according to claim 1, wherein said first end of the bone plate includes at least two longitudinally adjacent slots.

4. The osteosynthesis plate according to claim 1, wherein said second end of the base plate includes at least one slot that is substantially identical to a slot in said first end.

* * * * *